US005172855A

United States Patent [19]

Coffey

[11] Patent Number: 5,172,855

[45] Date of Patent: Dec. 22, 1992

[54] CONTINUOUS MAILER FORM

[75] Inventor: James B. Coffey, Dayton, Ohio

[73] Assignee: NCR Corporation, Dayton, Ohio

[21] Appl. No.: 678,927

[22] Filed: Apr. 1, 1991

[51] Int. Cl.[5] ..... B65D 27/06; B65D 27/10

[52] U.S. Cl. ..... 229/305; 229/69

[58] Field of Search ..... 229/69, 305

[56] References Cited

U.S. PATENT DOCUMENTS

| | | | |
|---|---|---|---|
| 3,325,188 | 6/1967 | Hiersteiner | 229/69 |
| 3,419,286 | 12/1968 | Noonan et al. | 229/69 |
| 3,905,545 | 9/1975 | Juszak et al. | 229/69 |
| 4,051,995 | 10/1977 | Wieman | 229/69 |
| 4,161,091 | 7/1979 | Hartzig . | |
| 4,418,865 | 12/1983 | Bowen . | |
| 4,435,001 | 3/1984 | Mills et al. | 229/69 |
| 4,645,123 | 2/1987 | Ashby | 229/69 |
| 4,747,535 | 5/1988 | Haase et al. | 229/69 |
| 4,770,337 | 9/1988 | Leibe | 229/69 |
| 4,840,306 | 6/1989 | Lombardo . | |
| 4,895,297 | 1/1990 | Klamm | 229/69 |
| 4,960,237 | 10/1990 | Bendel . | |
| 5,040,720 | 8/1991 | Pennock | 229/69 |

*Primary Examiner*—Stephen P. Garbe

*Attorney, Agent, or Firm*—George J. Muckenthaler

[57] ABSTRACT

A business form has a first ply and a second ply with an insert ply therebetween. The insert ply has a cutout portion along the upper edge of a certain dimension and a cutout portion along the lower edge of a lesser dimension than the cutout portion along the upper edge, the upper cutout portion accommodating adhesive for sealing a return envelope of a mailer that uses the same ply for the back of the outgoing mailer and for the back of the return envelope.

13 Claims, 7 Drawing Sheets

CONTINUOUS MAILER FORM

BACKGROUND OF THE INVENTION

In the field of business forms, a continuous mailer is commonly used by many businesses for the purpose of sending statements or bills to customers. The continuous mailer is comprised of a plurality of plies or sheets which are assembled and secured by means of lines of adhesive to an adjacent ply or sheet. Additional means for securing portions of a ply or sheet to other portions include lines of perforations which enable a portion to be easily removed from an adjacent portion. The several plies or sheets include printed matter in the form of messages or instructions for the use of the business or of the customer. The printing is normally performed on a business forms press and the several plies or sheets are then collated, glued by means of lines or spots of glue, die cut to provide precise sizes for the plies or sheets, perforated in both the horizontal and vertical directions, as required, and then folded along horizontal lines of perforations to produce a product ready for use by the business.

The continuous mailer form is imprinted by means of a computer and a line printer to transfer data or information to internal or underlying plies or sheets of the form by use of various image transfer methods. The imprinted forms are further processed to remove the margins which include the pin feed holes on either side of the folded product, decollated to remove a record copy or copies which are retained by the business, and bursted along the horizontal lines of perforations to produce a single business form that in a finished state can be mailed directly by the business to a customer.

These continuous mailer type forms eliminate the need and added cost for inserting a printed document into a conventional envelope, and then closing and sealing the envelope before mailing to the customer. In the process for producing these forms, it is common practice to use a die cutting technique wherein a chip of a common size, as $\frac{5}{8}''$ or $\frac{3}{4}''$ wide, is removed between adjacent and successive forms that have been printed on a continuous web of forms. The die cutting is normally performed on the insert ply or plies and on additional plies that are intended to provide a return envelope for the customer to use in paying a statement or bill. Removing the die cut chip enables and provides a means whereby a cross-web glue line or lines of glue can be applied to one ply either above or below the insert ply to form a sealed envelope type construction that contains the insert ply or plies and a return envelope. The two outer plies are normally glued along each end to provide an outgoing envelope along with an internal ply or plies that can be mailed to the end user or customer, and the customer then removes the internal ply and uses the return envelope to mail the internal ply along with a check or like document to the business for paying the bill.

Another means that can be used to provide an area on the business form for the purpose of applying cross-web glue lines is to produce a form that includes a free insert or one which is free of adjacent plies. In this particular form, the insert and the return envelope are mechanically cut and placed in equally spaced manner between adjacent forms. The face and the back of the outgoing envelope which contains the free insert is constructed in exactly the same manner as described above for the die cut construction. It should be noted that in both constructions described above, the area of the form that is allotted for the cross-web glue lines between adjacent forms that are printed on a continuous web is equal on each form and is normally 5/16" or $\frac{3}{8}''$ on both the top and bottom edges of the form. This method of cross-web gluing and die cutting or spacing of the internal parts or plies creates a problem by reason that all internal parts are normally die cut or equally spaced simultaneously. Thus, all parts are cut to the same size at the top and bottom of each form in the web direction. In addition the insert parts are normally placed above the return envelope parts for improved legibility reasons at the line printing operation during the post printing of the mailer forms. Also, it should be noted that in order to provide a sealing flap for the return envelope, a small section of the side opposite the side that contains the sealing flap (with remoistenable glue applied) must be removed before the return envelope can be properly sealed. Removal of the small section or portion opposite the sealing flap is normally done by the end user or customer by hand or by means of a removable strip. In this type construction, the small section is glued to the back ply of the outgoing envelope and is removed simultaneously when the outgoing envelope is opened by means of the removable strip. The envelope is opened from the back side in an arrangement defining a zipper type construction.

The zipper type construction is used by many suppliers of business forms. In order to use the zipper type construction to remove the small section, it is necessary to open the outgoing envelope by turning the envelope over and removing the contents from the backside. In a snap-out type construction, the small section is removed by hand after the internal parts are removed from the outgoing envelope. This method is cumbersome, causes fumbling of the parts, and is confusing to many customers. Another disadvantage of this type construction wherein the return envelope is die cut and produced simultaneously with the free insert is that the return envelope requires two parts or plies to produce a return envelope in addition to the two parts or plies that make up the front and the back of the outgoing envelope.

Representative documentation in the field of continuous type business forms used for mailers includes U.S. Pat. No. 4,418,865, issued to C. G. Bowen on Dec. 6, 1983, which discloses a continuous mailer assembly having three plies which define an outgoing envelope with a removable tab, a message ply and a return envelope.

U.S. Pat. No. 4,840,306, issued to L. Lombardo on Jun. 20, 1989, discloses a fold-over mailer having two plies secured about their marginal edges with an intermediate ply secured about three of its four edges to one of the plies.

SUMMARY OF THE INVENTION

The present invention relates to multiple ply business forms for use in mailing data or information by businesses to customers. More particularly, the present invention relates to continuous type business forms that include several plies or sheets which are secured in a manner to provide an outgoing envelope, at least one insert ply, and a return envelope. The continuous type business forms in the form of mailers are produced from continuous webs of individual sheets or strips of paper which are run through a printing press for printing data or information on selected sheets or strips and then collated to form a continuous web of business forms incorporating the individual sheets or strips.

In accordance with the present invention, there is provided a business form for use as a mailer comprising a first ply including space for entering information regarding a mailing transaction, said first ply having a first line of weakening spaced from one edge of said first ply and a second line of weakening spaced from the opposite edge of said first ply enabling removal of the first ply from the business form, a second ply having printed indicia thereon and including space thereon substantially the same as on said first ply, said second ply having a first line of weakening spaced from one edge of said second ply and a second line of weakening spaced from the opposite edge of said second ply enabling removal of the second ply from the business form, a third ply secured to said second ply adjacent one edge thereof, a fourth ply having a first line of weakening spaced from one edge and a second line of weakening spaced from the opposite edge, said fourth ply being secured to said second ply adjacent said opposite edges of said second and said fourth plies and secured to said third ply adjacent said one edge, a fifth ply secured to said fourth ply adjacent said one edge of said fourth ply and secured to said fifth ply adjacent said opposite edge of said fourth ply, said fifth ply including a strip containing a plurality of remoistenable glue areas for securing said strip to said fourth ply for sealing said form.

In accordance with the above discussion, a principal object of the present invention is to provide a continuous type business form which is used as a mailer by businesses.

Another object of the present invention is to provide a business form that includes a minimum number of sheets or plies to construct a mailer having a return envelope.

An additional object of the present invention is to provide a mailer that enables all steps of utilization from one side of the mailer.

A further object of the present invention is to provide a mailer with a return envelope that is sufficiently large to enable insertion of at least one or a plurality of documents without folding of such documents.

Additional advantages and features of the present invention will become apparent and fully understood from a reading of the following description taken together with the annexed drawing.

DESCRIPTION OF THE PREFERRED EMBODIMENT

Figure 1:
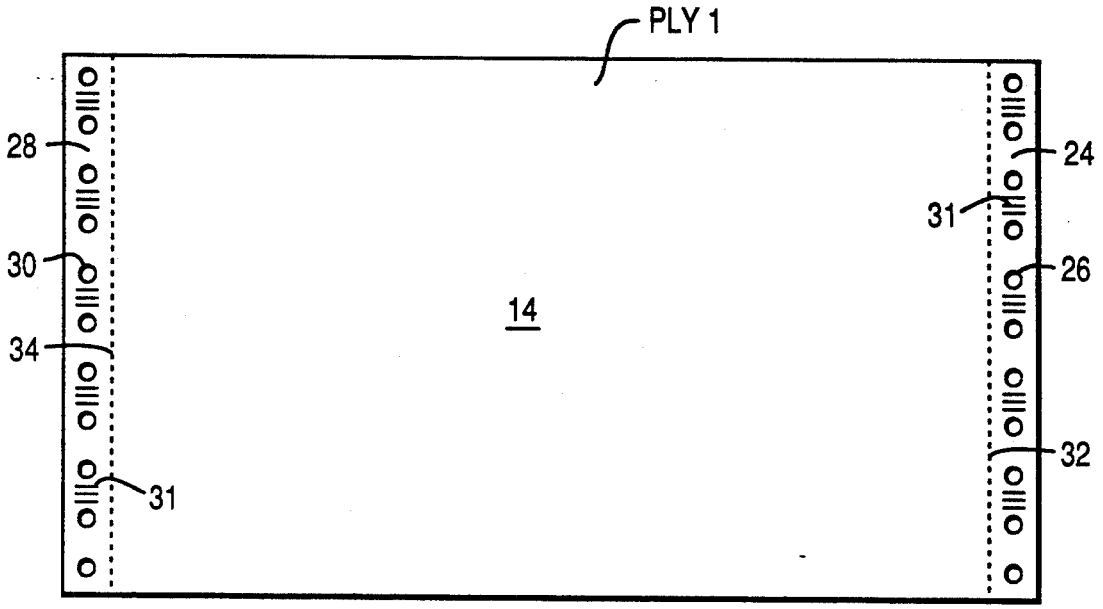
FIG. 1 is a plan view of a top or record ply of a mailer form of the present invention.

Referring now to the drawing, FIGS. 1-6 show plan views of the several plies of a business form that is formed from continuous webs of paper to provide a mailer assembly that is used to mail data or information to customers. The mailer assembly is made up of a plurality of sheets or plies in web form and collated to form a continuous strip of such sheets or plies. The continuous mailer assembly is processed by bursting along transverse lines of perforations which are equally spaced in the direction of the continuous web to form a business form in the nature of a mailer or mailer assembly, generally designated as 12 in FIGS. 8 and 9. The mailer 12 is used by businesses to send data, information or messages to customers, one of the most prevalent being statements for goods or services. The mailer contains an insert sheet which is generally sent back or returned to the business in a return envelope along with a check or like document for paying the statement or bill for the goods or services.

The mailer is formed into an assembly of sheets or plies (FIG. 7) which include a first ply or record copy 14 that is normally retained by the business or sender of the mailer. A second ply or sheet 16 serves as the top of the outgoing envelope, a fourth ply or sheet 18 serves as the face of a return envelope and a third ply or sheet 20 serves as an insert or message ply which is returned to the sender. A fifth ply or sheet 22 is a common ply and serves as the back of both the outgoing and the return envelopes.

Figure 7:
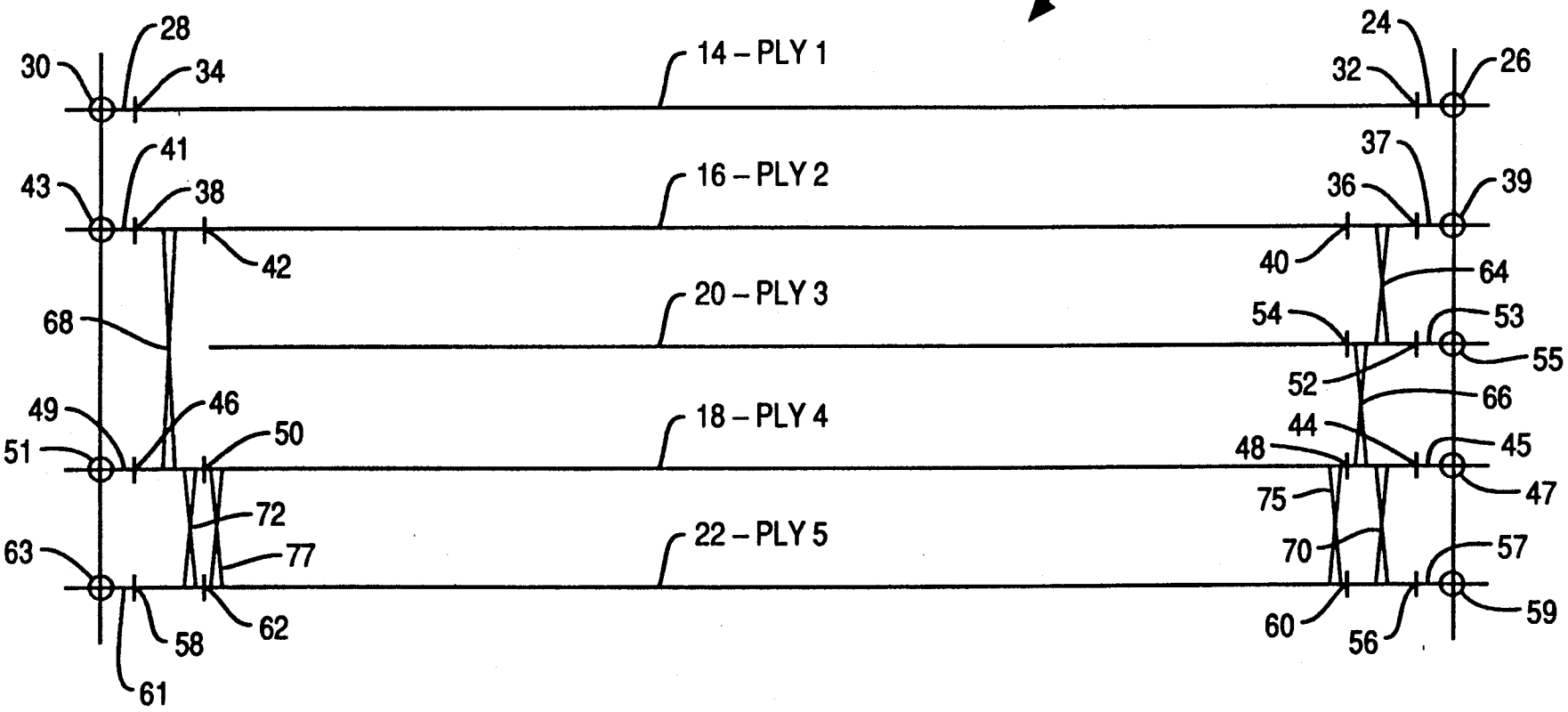
FIG. 7 is an end view of the mailer form with the several plies being separated in exaggerated manner to show the construction.

The record copy 14 (FIG. 1) includes a right hand margin 24 with pin feed holes 26 and a left hand margin 28 with pin feed holes 30, which construction is required in continuous feed operations and is well-known in the art. The record copy or first ply 14 has a first line of perforations 32 adjacent the pin feed holes 26 in the margin 24 and the first ply 14 has a second line of perforations 34 adjacent the pin feed holes 30 in the margin 28 (FIGS. 1 and 7). Since the margins 24 and 28 along with the respective pin feed holes 28 and 30 therein are removed by the user of the business form prior to mailing and since each of the several plies includes a right hand margin and a left margin which are removed along the lines of perforations forming the margins, it is deemed necessary to recite the respective lines of perforations in each of the plies making up the business form.

Figure 2:
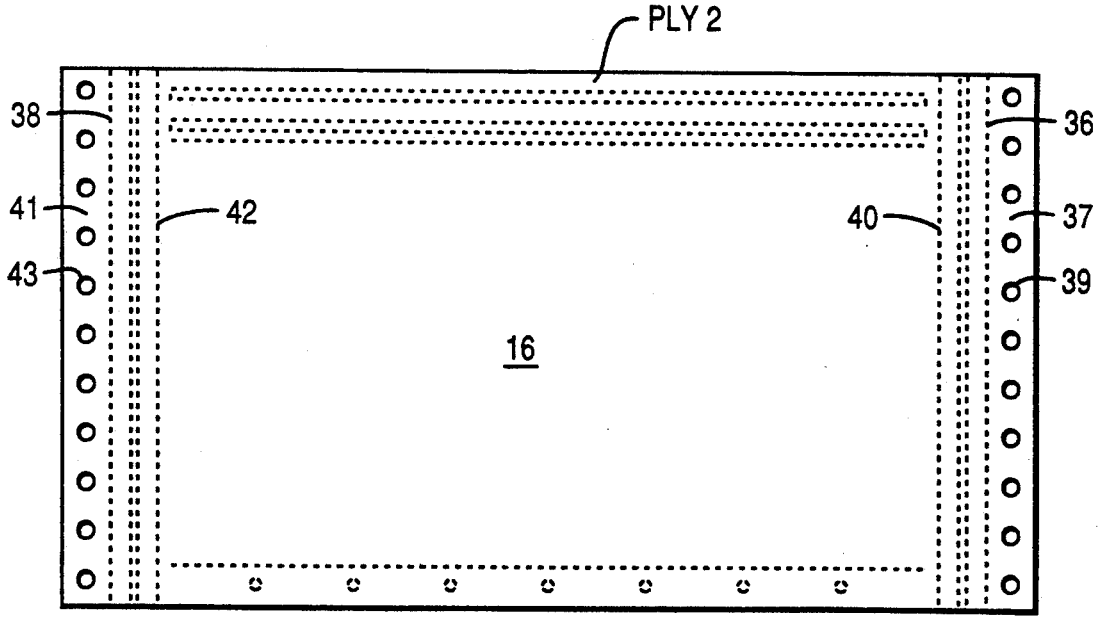
FIG. 2 is a plan view of a ply used as the top of an outgoing envelope.

The second ply 16 (FIG. 2) has a first line of perforations 40 spaced from one edge of the first ply and a second line of perforations 42 spaced from the opposite edge of the first ply. Ply 16 has a right hand margin 37 with pin feed holes 39, the right hand margin being attached to the body of the ply 16 by a perforated line 36. Ply 16 has a left hand margin 41 with pin feed holes 43, the left hand margin being attached to the body of the ply 16 by a perforated line 38 (FIGS. 2 and 7). Ply 14 and ply 16 are secured by means of crimping or paper staples, as 31, in margins 24 and 28 (FIG. 1).

Figure 4:
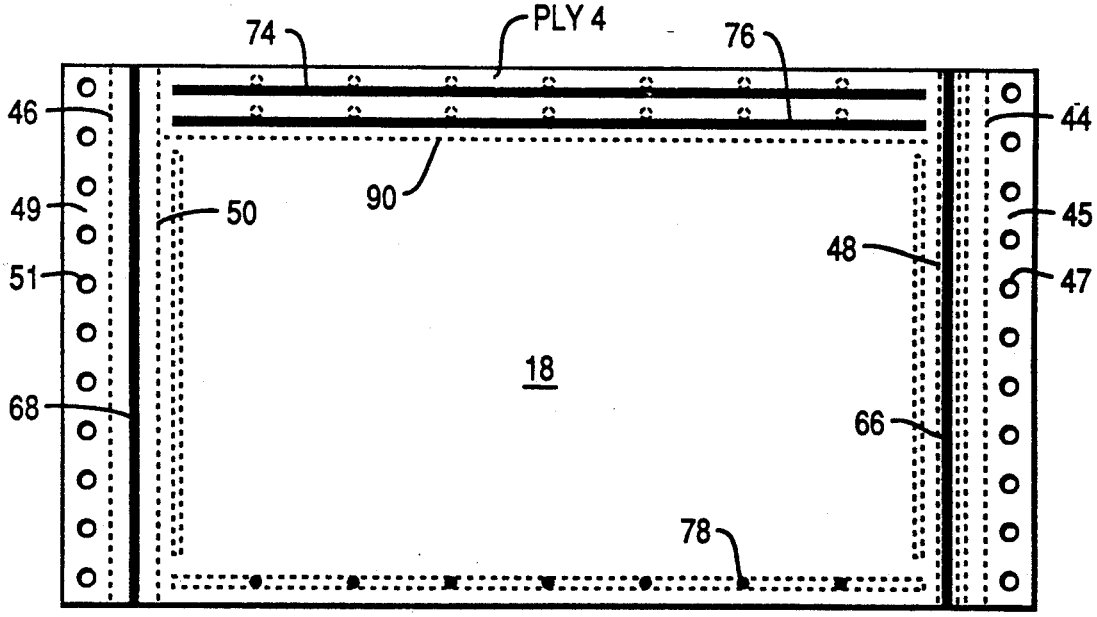
FIG. 4 is a plan view of a ply used as the face of a return envelope.

The fourth ply 18 (FIG. 4) has a first line of perforations 44 forming the right hand margin 45 and a second line of perforations 46 forming the left hand margin 49 of the second ply 18. Right hand margin 45 has pin feed holes 47 and left hand margin 49 has pin feed holes 51 (FIGS. 4 and 7). A third line of perforations 48 is spaced from one edge of the fourth ply 18 and inward of the perforated line 44, and a fourth line of perforations 50 is spaced from the opposite edge of the ply 18 and inward of the perforated line 46.

Figure 3:
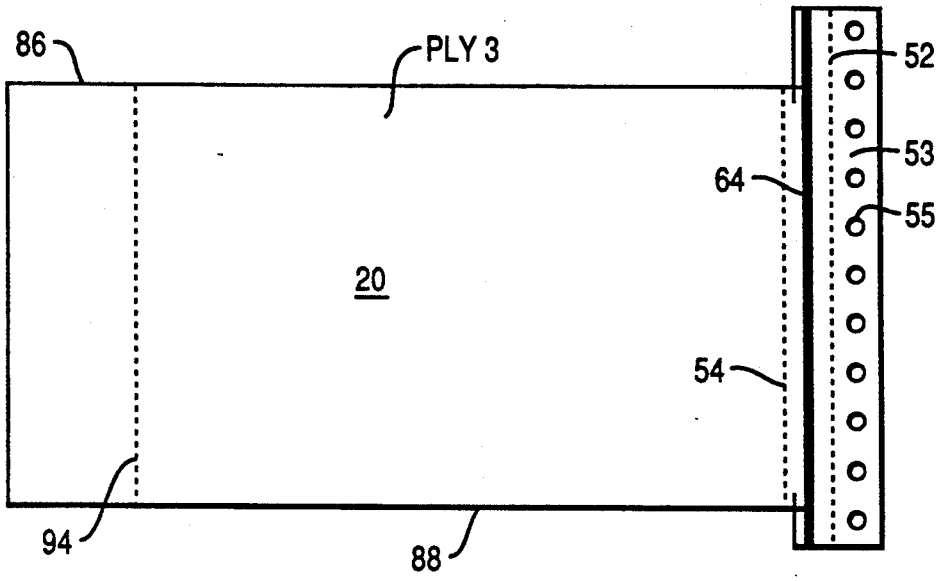
FIG. 3 is a plan view of an insert ply of the mailer form.
Figure 5:
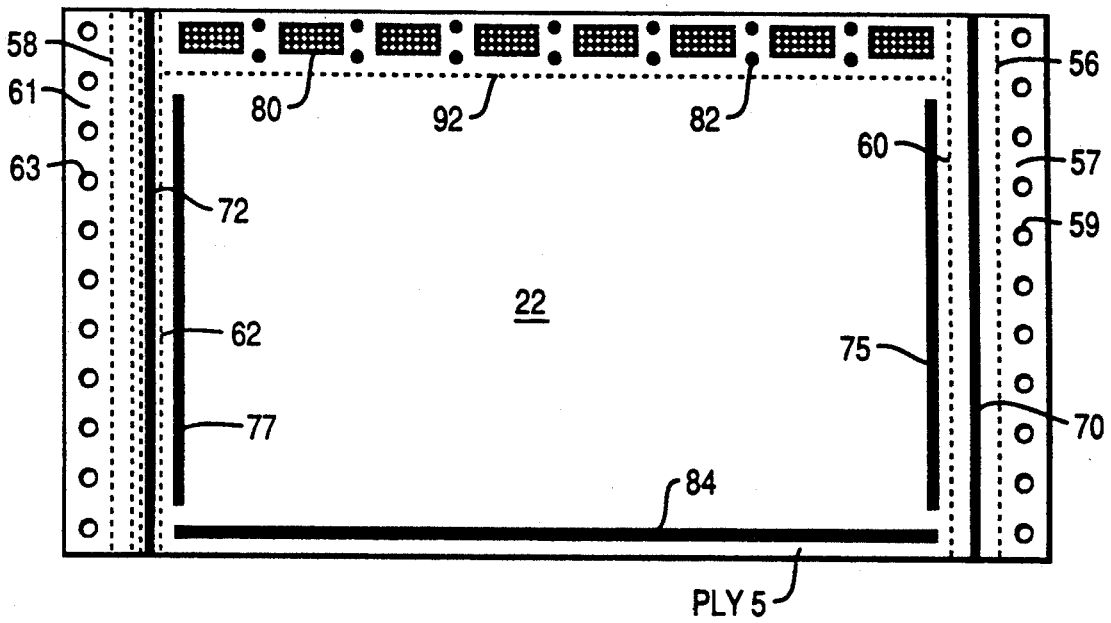
FIG. 5 is a plan view of a ply used as the back of a common outgoing/return envelope.

A first line of perforations 52 is provided in the third or insert ply 20 (FIG. 3) and a second line of perforations 54 is provided in the third ply adjacent the right hand edge thereof and inward of the first line of perforations 52. A right hand margin 53 with pin feed holes 55 is attached to the body of ply 20 by the perforated line 52 (FIGS. 3 and 7). The fifth ply 22 (FIG. 5) has a first right hand line of perforations 56 and a first left hand line of perforations 58 at a right hand margin 57 and at a left hand margin 61, respectively, of the fifth ply 22. The fifth ply 22 also includes a third line of perforations 60 adjacent the right hand edge thereof and inward of the perforated line 56, and a fourth line of perforations 62 adjacent the left hand edge thereof and inward of the perforated line 58 (FIGS. 5 and 7).

The second ply 16 is secured to the third ply 20 (FIGS. 3 and 7) along the right hand edge by means of a line of adhesive or glue line 64. The third ply 20 is secured to the fourth ply 18 (FIGS. 4 and 7) along the right hand edge by means of a line of adhesive or glue line 66 which is inwardly of glue line 64. The second ply 16 is secured to the fourth ply 18 (FIGS. 4 and 7) along the left hand edge by means of a line of adhesive or glue line 68. The fourth ply 18 is secured to the fifth ply 22 (FIGS. 5 and 7) along the, right hand edges of the two plies by means of a glue line 70 and the fourth ply 18 is secured to the fifth ply 22 along the left hand edges of the two plies by means of a glue line 72. As seen in the end view of the mailer assembly 12 in FIG. 7, glue lines 64 and 70 along the right hand edge are aligned with each other, and glue line 66 is inward of glue lines 64 and 70. Also in FIG. 7, it is seen that glue line 72 along the left hand edge of the mailer assembly 12 is inward of glue line 68. A glue line 75 is located on ply 22 inward of perf line 60 and a glue line 77 is located on ply 22 inward of perf line 62, as illustrated in FIGS. 5, 7, 8 and 9, for securing ply 18 to ply 22 at the sides thereof. The glue lines 75 and 77 along with glue line 84 form a pocket for the insert ply 20. As illustrated in FIG. 5, glue lines 75 and 77 extend to a point short of perf line 92 (approximately the top edge of ply 18) thereby allowing the top edge of ply 18 to move outwardly from ply 22 and enable convenient insertion of ply 20.

Figure 8:
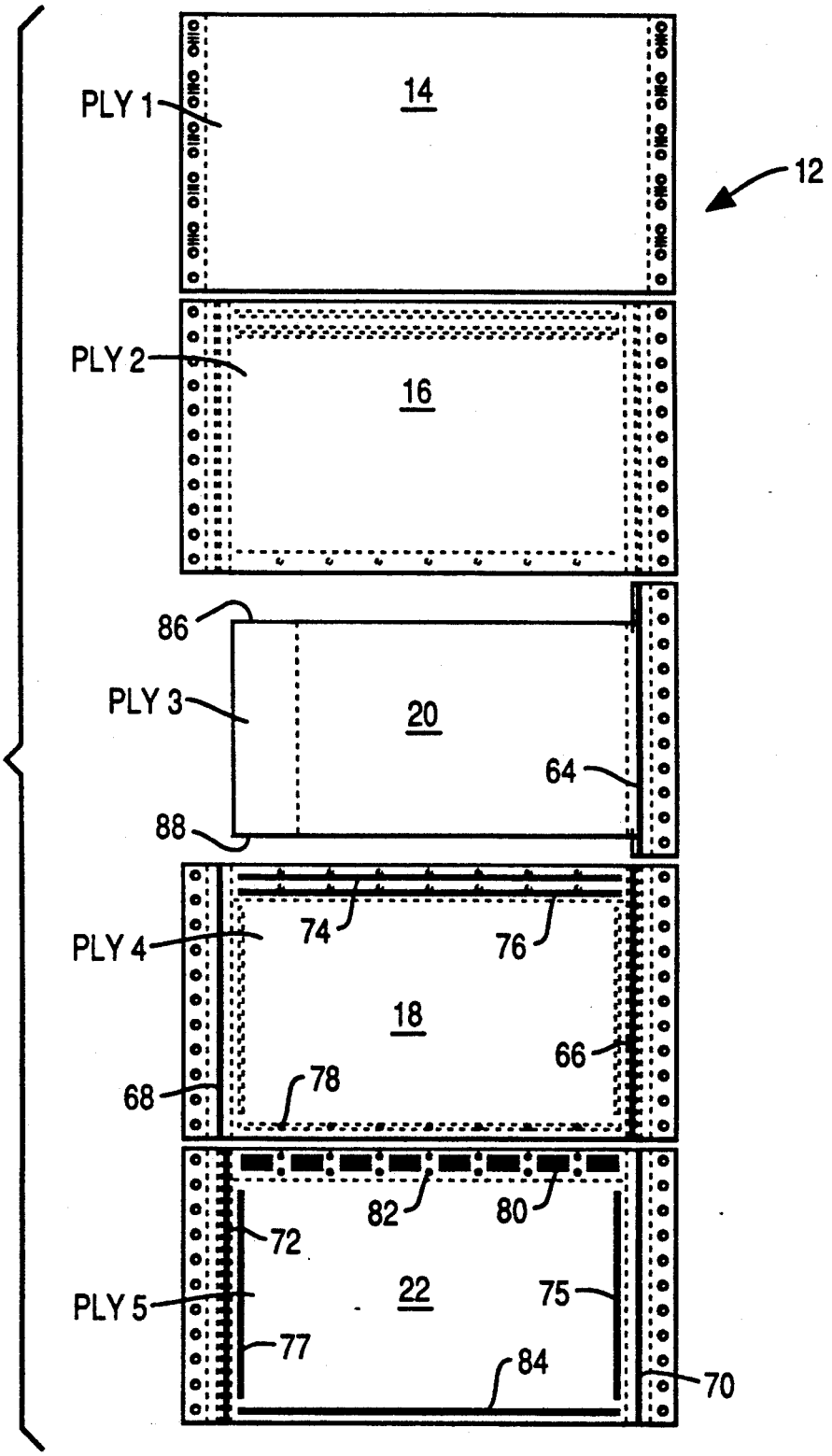
FIG. 8 is a plan view of the several plies and the order of assembly of the mailer form.

Additionally, the second ply 16 and the fourth ply 18 are secured along the upper edges of the two plies by means of a pair of parallel glue lines 74 and 76 (FIGS. 4 and 8). A plurality of spaced glue spots 78 are provided on the fourth ply 18 along the lower edge thereof for attaching the lower edges of plies 16 and 18. Remoistenable glue is provided at a plurality of areas 80 along the upper edge of the fifth ply 22 (FIGS. 5 and 8) and a plurality of glue spots 82 are provided between the areas 80 along the upper edge of the ply 22. A glue line 84 is provided along the lower edge of the fifth ply 22 for attaching the lower edges of plies 18 and 22.

Figure 6:
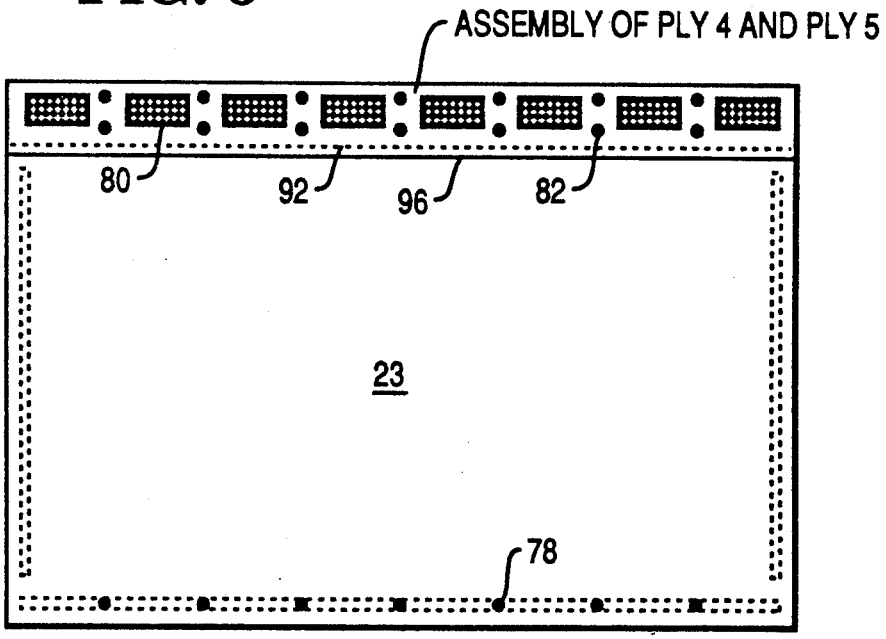
FIG. 6 is a plan view of the face of a return envelope which is ready to be sealed by the user.

Both cross-web glue and line glue are used to produce an outgoing envelope comprising plies 16 and 22. In addition cross-web glue, line glue and a fold over flap with remoistenable glue applied thereto are used to combine plies 18 and 22 to form a return envelope. The combining of plies 18 and 22 in this manner is commonly referred to as a "plysaver envelope" because ply 22 is a common ply and is used as the back ply for both the outgoing envelope and for the return envelope. This is best illustrated in FIG. 8 which shows the several plies of the mailer 12. The face of the return envelope shown as ply 23 in FIG. 6, along with ply 22 as the back of the return envelope comprise the means for returning a payment or the like by the customer to the sending party. The face of the return envelope, as ply 23, is shown in FIG. 6 with the right hand margin 57 and the left hand margin 61 along with the glue line stubs removed from the envelope shown in FIG. 5.

Figure 9:
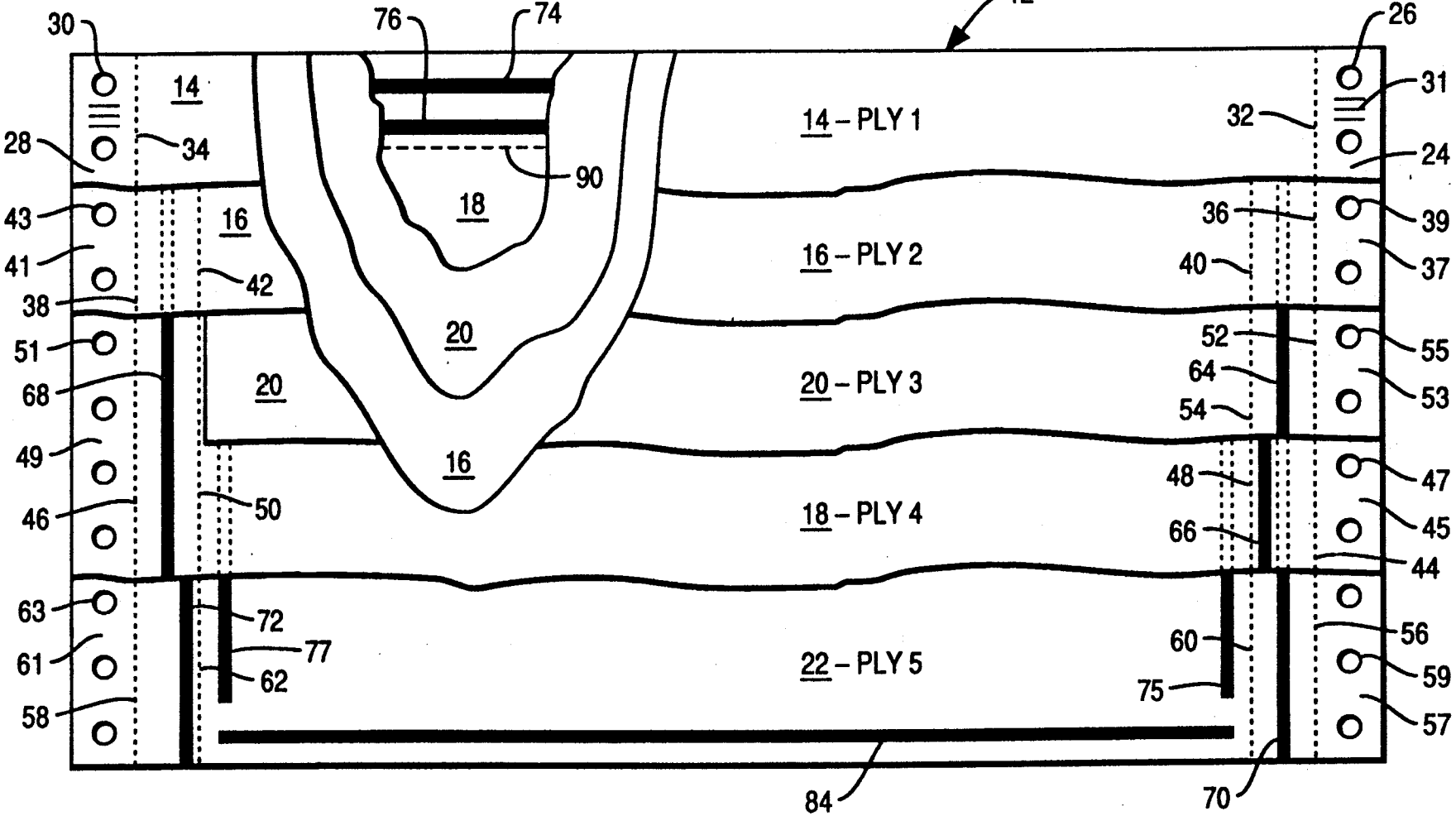
FIG. 9 is a plan view of the mailer form with portions of the several plies broken away to show the relationship of the several plies to each other.

FIG. 9 shows the arrangement of the several plies 14, 16, 18, 20 and 22 in the assembly of the mailer 12, along with the respective glue lines 64, 66, 68, 70, 72, 74, 76, 75, 77 and 84. It is not believed necessary to repeat all the elements including perforated lines and margins of the mailer assembly 12, however, FIG. 9 illustrates the overlapping and relative position of the several plies.

Figure 10:
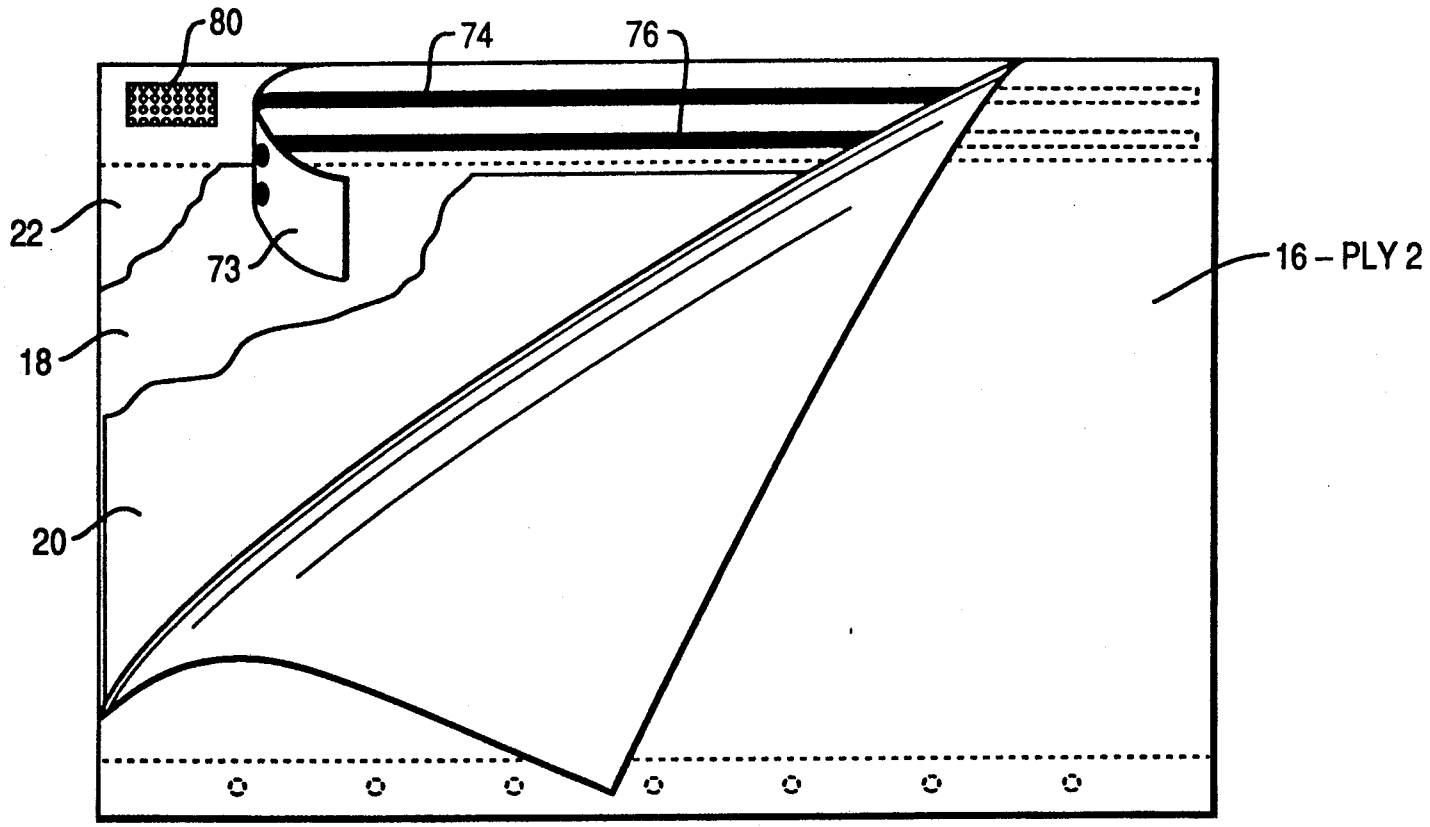
FIG. 10 is a plan view showing the several plies and showing the removal of a strip portion from one ply.

FIG. 10 shows the second ply 16 being peeled from the fourth ply 18 along with a strip portion 73 of ply 18 being removed to expose the adhesive areas 80 on ply 22. The strip portion 73 is removed from ply 18 by the customer to enable insertion of the third ply 20. FIG. 10 also illustrates the relative positions of the plies 16, 20, 18 and 22 of the mailer assembly 12 less the first or record ply 14.

It should be noted that the printed data or information is transferred from an outside or top ply, as 14, to internal plies, as 20, and, if required, to the face 23 of the return envelope. Various imaging techniques such as hot spot carbon, pattern carbon and carbonless coatings can be used to transfer an imprinted message or data from the outside ply to an internal ply.

The insert ply 20 has a die chip cutout area or portion 86 of 13/16" wide at the top of the ply, as shown in FIG. 3, and a die cut chip out area or portion 88 at the lower edge of the ply. The greater die cut area or portion 86 of ply 20 provides a means for securing a portion of ply 18 at the upper edge thereof to the ply 16 by the cross-web glue lines 74 and 76. The portion of ply 18 that is secured to ply 16 by lines 74 and 76 is ¾" wide and is bounded by the edge at the top of ply 18 and a perforation line 90 (FIG. 4) which is located ¾" from the top edge of ply 18. The ¾" wide portion is bounded by the perforation line 48 on the right hand side and by the perforation line 50 on the left hand side of the ply 18. As noted above, the ply 16 is secured to the ply 18 at the lower edge thereof by the line of glue spots 78 (FIG. 4).

The customer or end user of the mailer is prompted by a printed message or messages, normally along the upper edge, the lower edge, or the side edges of the mailer to remove the ½" wide glue stub at each side of the outgoing envelope and then to slowly peel ply 16 back to open the outgoing envelope. The removal of ply 16 in this manner is commonly referred to as a "peel-a-part" construction. As noted above, the back side of the ¾" wide portion of ply 18 is secured by the line of glue spots 82 along the top edge of ply 18 to ply 22. The glue spots 82 are located adjacent the remoistenable areas 80 that are applied to the face side of ply 22 near the upper edge thereof.

The combination of the glue spots or dots 78 and 82 between ply 16 and ply 18 and between ply 18 and 22 along with the ¾" wide portion which is glued to ply 16 and the perforated line on one side of the ¾" wide portion provides a means or method whereby the ¾" wide portion of ply 18 is separated from ply 18 at the perforated line 90 when ply 16 is removed or peeled back (FIG. 10). It is to be noted that ply 20 is totally exposed and becomes a loose part of the mailer after the ½" wide glue stubs and ply 16 have been separated from the mailer. After the ¾" wide portion or strip is removed from ply 18, the ⅝" wide portion or strip located at the top side of ply 22 can be folded over the face side of ply 18. The remoistenable glue areas 80 on ply 22 are used to allow ply 18 and ply 22 to be used as the return envelope.

Referring back to FIG. 3, the insert ply 20 is illustrated and is of a size to be inserted or stuffed into the return envelope formed by plies 18 and 22 after the margin 53 and the stub portion occupied by glue line 64 are removed along perforated line 54. This size insert ply 20 enables the maximum area for printing.

An option or alternative arrangement for ply 20 is to provide a perforated line 94 (FIG. 3) at a minimum distance of ¾" from the left hand edge. The insert ply 20 can be easily folded on the perforated line 94 to enable the ply to be inserted into the return envelope.

Another alternative arrangement of the insert ply 20 is to reduce the width of the ply by an amount so as to enable easy insertion into the return envelope. The width of ply 20 could be reduced to the location of the perforated line 94.

It should be noted that the present invention provides a mailer wherein the outgoing envelope, which is received by the customer, can be opened facing the front side of the outgoing envelope. The insert ply is completely exposed and presented as a loose part after removal of the right hand side of the mailer along the perforated line 54. Ply 18 and ply 22 will be readily recognized as a return envelope with the remoist glue 80 along the envelope flap and the pocket formed by the glue lines 75 and 77 and the cross-web glue line 84 securing ply 18 and ply 22.

In this invention, it is seen that the customer can read all instructions on the mailer, can open the outgoing envelope, remove the insert ply, place a document inside the return envelope, and seal the return envelope while viewing the mailer in a single plane. This procedure can be accomplished while viewing the face side of the outgoing envelope. In addition, all instructions for using the mailer are printed on a single side of the outgoing envelope which simplifies the process of opening and using the mailer. It is to be noted that the present invention provides a return envelope which is greater in height than one which is produced by die cutting the insert and the return envelope parts simultaneously and wherein the insert ply is equally spaced at the upper and the lower sides.

It is thus seen that herein shown and described is a mailer that uses minimum parts or plies to provide for an outgoing envelope and a return envelope and which can be used in a manner wherein all steps can be performed while viewing one side of the mailer. The mailer of the present invention enables the accomplishment of the objects and advantages mentioned above, and while a preferred embodiment has been disclosed herein, variations thereof may occur to those skilled in the art. It is contemplated that all such variations not departing from the spirit and scope of the invention hereof are to be construed in accordance with the following claims.

What is claimed is:

1. A mailer comprising a first ply having a first line of perforations adjacent one edge of said first ply and a second line of perforations adjacent the opposite edge of said first ply, a second ply having a first line of perforations adjacent one edge of said second ply and a second line of perforations adjacent the opposite edge of said second ply, said first ply and said second ply being secured by crimping means adjacent said first line of perforations in said first ply and adjacent said first line of perforations in said second ply, a third ply having a first line of perforations adjacent one edge of said third ply and a second line of perforations spaced from said first line of perforations in said third ply, a fourth ply having a first line of perforations adjacent one edge of said fourth ply and a second line of perforations adjacent the opposite edge of said fourth ply, said second ply and said fourth ply being secured by a line of adhesive adjacent said opposite edges of said second ply and said fourth ply, and a fifth ply forming the back ply of said mailer and having a first line of perforations adjacent one edge of said fifth ply and a second line of perforations adjacent the opposite edge of said fifth ply, said third ply being positioned between said second ply and said fourth ply, said third ply being secured to said second ply by adhesive means adjacent said first line of perforations in said third ply and said third ply being secured to said fourth ply by adhesive means adjacent said first line of perforations in said fourth ply and inward of said first mentioned adhesive means, said fourth ply being secured to said fifth ply by first line adhesive means adjacent said first line of perforations in said fifth ply and being secured to said fifth ply by second line adhesive means adjacent said second line of perforations in said fifth ply and inward of said line of adhesive adjacent said opposite edges of said second ply and said fourth ply, said fifth ply including third line adhesive means inward of said first line adhesive means and fourth line adhesive means inward of said second line adhesive means for securing said fourth ply and said fifth ply, and said fifth ply including fifth line adhesive means securing said fourth ply and said fifth ply for forming a pocket for said third ply, said third ply defining a cutout portion along the upper edge thereof for accommodating adhesive means securing said second ply and said fourth ply adjacent the upper edges thereof and said third ply defining a cutout portion along the lower edge thereof of lesser dimension than the dimension of the cutout portion along the upper edge for accommodating adhesive means securing said second ply and said fourth ply adjacent the lower edges thereof.

2. The mailer of claim 1 wherein said first mentioned adhesive means comprises a line of adhesive spaced from said one edge of said third ply.

3. The mailer of claim 1 wherein said second mentioned adhesive means comprises a line of adhesive spaced from said one edge of said fourth ply.

4. The mailer of claim 1 wherein said third mentioned adhesive means comprises a pair of lines of adhesive spaced from said upper edges of said second ply and said fourth ply.

5. The mailer of claim 1 wherein said fourth mentioned adhesive means adjacent the lower edge of said second ply comprises dots of adhesive spaced from said lower edges of said second ply and said fourth ply.

6. The mailer of claim 1 wherein said adhesive means securing said third ply and said second ply comprises a line of adhesive spaced inwardly of said first line of perforations in said second ply and inwardly of said first line of perforations in said third ply and outwardly of said second line of perforations in said third ply.

7. The mailer of claim 1 wherein said adhesive means securing said third ply and said fourth ply comprises a line of adhesive spaced inwardly of said first line of perforations in said fourth ply and inwardly of said first line of perforations in said third ply and inwardly of said adhesive means securing said third ply and said second ply and outwardly of said second line of perforations in said third ply.

8. The mailer of claim 1 wherein said fifth ply is secured by said first and said third line adhesive means to said fourth ply adjacent one edge of said fourth ply and said fifth ply and said fifth ply is secured by said second and said fourth line adhesive means to said fourth ply adjacent the opposite edges of said fourth ply and said fifth ply and said fifth ply is secured by said fifth line adhesive means to said fourth ply adjacent the lower edges of said fourth ply and said fifth ply.

9. A mailer comprising a first ply having a first line of perforations spaced from one edge of said first ply and a second line of perforations spaced from the opposite edge of said first ply, a second ply having a first line of perforations spaced from one edge of said second ply and a second line of perforations spaced from the opposite edge of said second ply, said first ply being secured to said second ply by crimping means adjacent said one edge and said opposite edge of said first ply and of said second ply, a third ply having a line of perforations spaced from one edge of said third ply, a fourth ply having a first line of perforations spaced from one edge of said fourth ply and having a second line of perforations spaced from the opposite edge of said fourth ply, said third ply being positioned between said second ply and said fourth ply and being secured by adhesive means spaced from said one edge of said third ply to said second ply and being secured to said fourth ply by adhesive means spaced inwardly of said first mentioned adhesive means securing said third ply to said second ply, said second ply and said fourth ply being secured by a line of adhesive adjacent the opposite edges of said second ply and said fourth ply, and a fifth ply having a first line of perforations spaced from one edge of said fifth ply and a second line of perforations spaced from the opposite edge of said fifth ply, said fifth ply being secured to said fourth ply by first adhesive means adjacent said one edge of said fifth ply and said fifth ply being secured to said fourth ply by second adhesive means adjacent said opposite edge of said fifth ply and inward of said line of adhesive adjacent the opposite edges of said second ply and said fourth ply, said first adhesive means and said second adhesive means securing said fourth ply and said fifth ply, and said second ply and said fifth ply being secured for forming an outgoing envelope of the mailer, and said fifth ply including third adhesive means inward of said first adhesive means and inward of said adhesive means securing said fourth ply and said third ply, and said fifth ply including fourth adhesive means inward of said second adhesive means for securing said fourth ply to said fifth ply, and said fifth ply including fifth adhesive means securing said fourth ply and said fifth ply and forming a pocket for said third ply for use as a return envelope of the mailer.

10. The mailer of claim 9 wherein said third ply defines a first cutout portion along an upper edge of said third ply and a second cutout portion along a lower edge of said third ply and said fourth ply includes adhesive means along an upper edge of said fourth ply and positioned within the defined first cutout portion of said third ply and said fourth ply includes adhesive means along a lower edge of said fourth ply and positioned within the defined second cutout portion of said third ply for securing said second ply to said fourth ply adjacent the upper edges and the lower edges of said second ply and said fourth ply.

11. A business form for use by a business as a mailing envelope in mailing information to a customer and for use by the customer in returning a portion of said business form to the business, said business form comprising an address ply having information thereon for use in mailing to the customer and having a line of perforations adjacent one edge and a line of perforations adjacent the opposite edge of the address ply, an insert ply having information thereon regarding a business transaction for use by the customer in returning said portion of said business form, said insert ply being secured to said address ply by adhesive means adjacent one edge of said insert ply, and a return envelope comprising a front ply and a back ply secured to each other to form a pocket for insertion of said insert ply by the customer for return to the business, said front ply having a line of perforations adjacent one edge and a line of perforations adjacent the opposite edge of the front ply and being secured to said insert ply by adhesive means positioned inward of said adhesive means adjacent one edge of said insert ply, said front ply being secured to said address ply by adhesive means adjacent the opposite edges of said front ply and said address ply, said pocket being formed by adhesive means adjacent one edge of said front ply and said back ply and positioned inward of said adhesive means securing said front ply and said insert ply and being formed by adhesive means adjacent the opposite edge of said front ply and said back ply and positioned inward of said adhesive means adjacent the opposite edges of said front ply and said address ply and being formed by adhesive means positioned adjacent the lower edge of said back ply, said insert ply defining a cutout portion along the upper edge thereof for accommodating adhesive means comprising a pair of lines of adhesive securing said address ply and said front ply and spaced from the upper edges of said address ply and said front ply and said insert ply defining a cutout portion along the lower edge thereof of lesser dimension than the dimension of the cutout portion along the upper edge for accommodating adhesive means comprising dots of adhesive securing said address ply and said front ply and spaced from the lower edges of said address ply and said front ply.

12. A method of making a business form for use by a business entity as a mailing envelope to a customer and for use by the customer in returning a portion of the business form to the business comprising the steps of:

providing a first ply of said business form having information regarding a mailing transaction and having a first line of perforations spaced from one edge of said first ply and a second line of perforations spaced from the opposite edge of said first ply, providing a second ply having a first line of perforations spaced from one edge of said second ply and a second line of perforations spaced from the opposite edge of said second ply and securing said first ply to said second ply by crimping means adjacent said one edge and said opposite edge of said first ply and of said second ply, providing a third ply having a line of perforations spaced from one edge of said third ply, providing a fourth ply having a first line of perforations spaced from one edge of said fourth ply and having a second line of perforations spaced from the opposite edge of said fourth ply, positioning said third ply between said second ply and said fourth ply and securing said third ply to said second ply by adhesive means spaced from said one edge of said third ply and securing said third ply to said fourth ply by adhesive means positioned inward of said adhesive means spaced from said one edge of said third ply, and securing said fourth ply and said second ply by adhesive means adjacent the opposite edge of said fourth ply and said second ply, and providing a fifth ply having a first line of perforations spaced from one edge of said fifth ply and a second line of perforations spaced from the opposite edge of said fifth ply, securing said fifth ply to said fourth ply by first adhesive means adjacent said one edge of said fifth ply and securing said fifth ply to said fourth ply by second adhesive means adjacent said opposite edge of said fifth ply, securing said second ply and said fifth ply for forming an outgoing envelope of the mailer, and securing said fifth ply and said fourth ply by third adhesive means positioned inward of said first adhesive means and securing said fifth ply and said fourth ply by fourth adhesive means positioned inward of said second adhesive means and positioned inward of said adhesive means adjacent the opposite edge of said fourth ply and said second ply, and securing said fifth ply to said fourth ply by fifth adhesive means positioned adjacent the lower edge of said fifth ply and forming a pocket for said third ply for use as a return envelope of the mailer.

13. The method of claim 12 including the further steps of removing the second ply from the fifth ply after receipt thereof by the customer, inserting the third ply into the pocket formed by the fourth ply and the fifth ply and sealing the return envelope formed by the fourth ply and the fifth ply all while viewing the business form from one side thereof.

* * * * *